US007897016B2

(12) United States Patent
Ewald

(10) Patent No.: US 7,897,016 B2
(45) Date of Patent: Mar. 1, 2011

(54) HEADBOX APPARATUS FOR A PAPERMAKING MACHINE

(76) Inventor: James Leroy Ewald, Stuart, FL (US)

( * ) Notice: Subject to any disclaimer, the term of this patent is extended or adjusted under 35 U.S.C. 154(b) by 463 days.

(21) Appl. No.: 12/012,514

(22) Filed: Jan. 31, 2008

(65) Prior Publication Data

US 2008/0179032 A1 Jul. 31, 2008

Related U.S. Application Data

(63) Continuation-in-part of application No. 11/642,054, filed on Dec. 19, 2006, now Pat. No. 7,794,570.

(60) Provisional application No. 60/898,628, filed on Jan. 31, 2007, provisional application No. 60/875,836, filed on Dec. 19, 2006, provisional application No. 60/763,439, filed on Jan. 30, 2006.

(51) Int. Cl.
*D21F 1/06* (2006.01)

(52) U.S. Cl. ..... 162/343; 162/336

(58) Field of Classification Search ..... 162/343, 162/336

See application file for complete search history.

(56) References Cited

U.S. PATENT DOCUMENTS

| | | | |
|---|---|---|---|
| 4,617,091 | A | 10/1986 | Rodal et al. |
| 5,110,416 | A | 5/1992 | Linsuri et al. |
| 5,147,509 | A | 9/1992 | Kuragasaki et al. |
| 5,183,537 | A | 2/1993 | Hergert et al. |
| 6,099,692 | A | 8/2000 | Weisshuhn et al. |
| 6,248,214 | B1 | 6/2001 | Stotz et al. |
| 6,383,614 | B1 | 5/2002 | Carson et al. |
| 6,432,275 | B1 | 8/2002 | Huovila et al. |
| 6,475,344 | B1 | 11/2002 | Aidun |
| 6,902,651 | B2 | 6/2005 | Fujiki et al. |

*Primary Examiner* — Mark Halpern
(74) *Attorney, Agent, or Firm* — David J. Archer

(57) ABSTRACT

A headbox apparatus for a papermaking machine is disclosed. The headbox apparatus defines a flow path for stock flowing between an upstream location and a downstream slice lip. The apparatus includes a plurality of blocks which are anchored within the flow path between the upstream location and the slice lip. Each block and an adjacent block of the plurality of blocks define therebetween a flow tube for the flow therethrough of the stock. The flow tube has an upstream portion having an upstream and a downstream end. The flow tube has a downstream portion having an upstream and a downstream extremity, the upstream extremity of the downstream portion extending from the downstream end of the upstream portion. The downstream portion of the flow tube has a volume which is greater than a further volume of the upstream portion of the flow tube such that when the stock flows from the upstream portion to the downstream portion of the flow tube, the stock is mixed within the downstream portion.

11 Claims, 8 Drawing Sheets

*Fig. 6.*
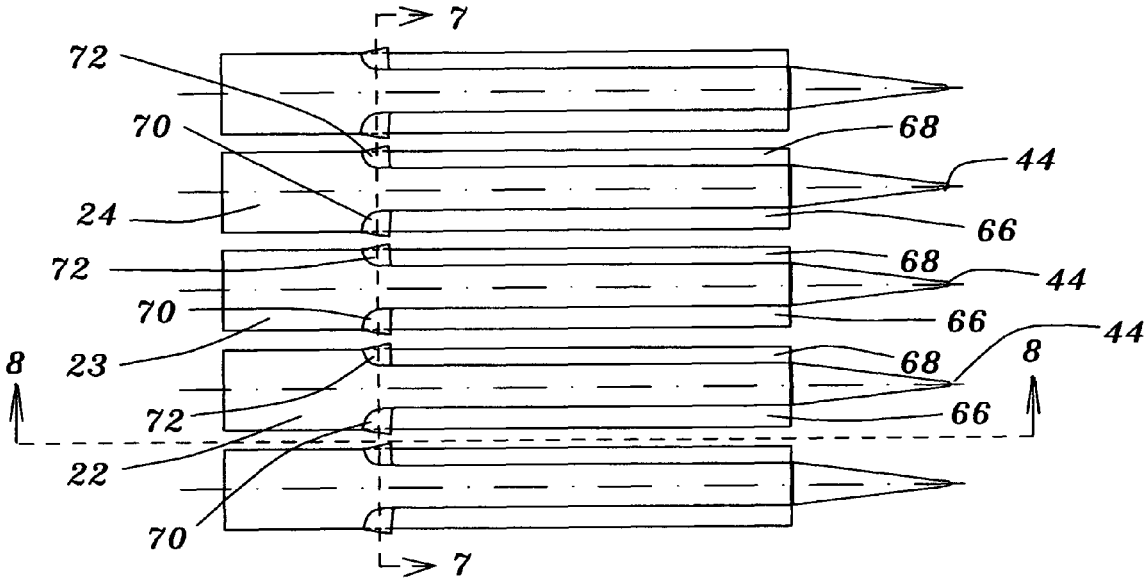
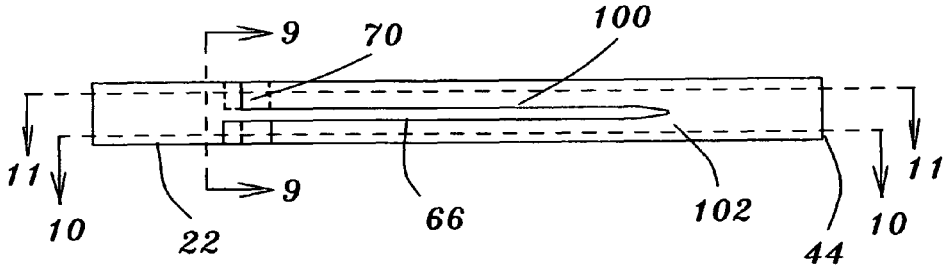
*Fig. 8.*

*Fig. 10.*
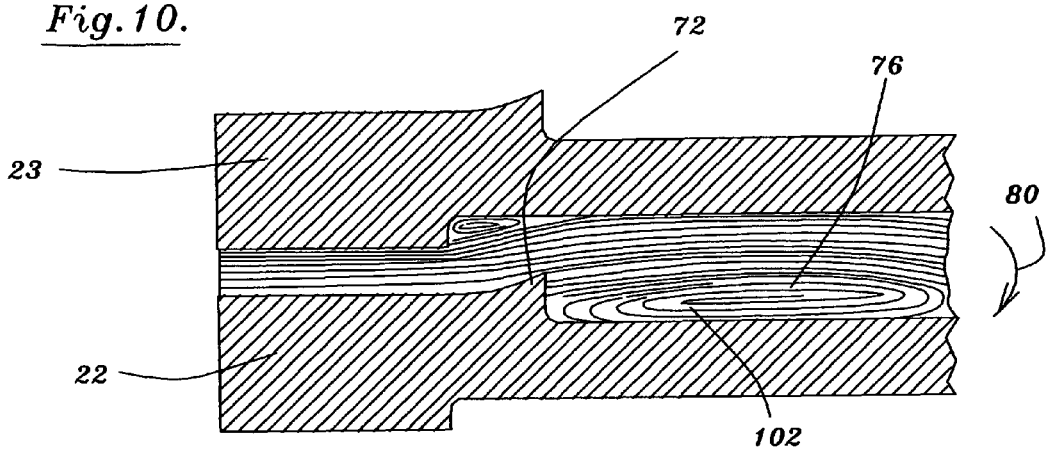
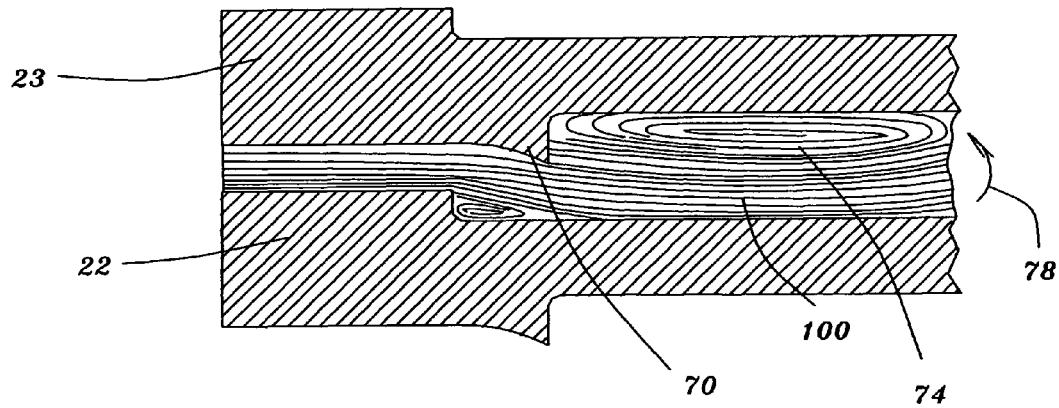
*Fig. 11.*

HEADBOX APPARATUS FOR A PAPERMAKING MACHINE

CROSS REFERENCE TO RELATED APPLICATIONS

The present application is a Complete application pursuant to Provisional patent application U.S. Ser. No. 60/898,628 filed Jan. 31, 2007 and a continuation-in-part of U.S. Ser. No. 60/875,836 filed Dec. 19, 2006 which was filed as a Complete application on Dec. 18, 2007 Express Mail label EB 713308134 U.S. and a continuation-in-part of U.S. Ser. No. 11/642,054 filed Dec. 19, 2006 now U.S. Pat. No. 7,794,570 which was filed as a Complete application pursuant to Provisional application U.S. Ser. No. 60/763,439 filed Jan. 30, 2006. All of the disclosure and subject matter of the aforementioned applications are incorporated herein by reference.

FIELD OF THE INVENTION

The present invention relates to a headbox apparatus for a papermaking machine.

More specifically, the present invention relates to a headbox apparatus for a papermaking machine in which the apparatus defines a flow path for stock flowing between an upstream header and a downstream slice lip.

BACKGROUND OF THE INVENTION

In a headbox of a papermaking machine, a vertical tube bank is located inside the headbox nozzle and distributes a uniform flow of fluid from the headbox delivery system to the headbox nozzle. The vertical tube bank is located between the pond sides and is trapped by the apron support structure and the top of the headbox nozzle. The fluid or stock is accelerated through the vertical slot openings into rectangular chambers located adjacent to one another. The discharge side of the vertical tube bank is nearly 100% open area into the headbox nozzle. The vertical openings provide a more uniform flow distribution requiring less mixing of individual flow streams and a uniform pressure drop across the tube bank which produces a better basis weight profile.

The vertical tube bank is constructed from metallic material. The flow passages in the tube bank are highly polished to prevent fiber from adhering to the surfaces.

In the headbox of the present invention, the tube bank is constructed from multiple segments or is constructed from a single block of material. When constructed from multiple pieces, the tube bank can be welded or glued together. Alternatively, clamping forces are utilized with through bolts to contain the internal forces of the stock pressure. The tube bank is constructed from multiple pieces stacked together to form the vertical tube bank. Multiple distinct sections that change the flow area within the flow chamber are assembled one after the other. The vertical tube bank front and drive side outside flow channels, or multiple front and drive side channels near the front and drive side walls, include a mechanism that alters the flow in these outer slots. This flow alteration provides a tool for controlling fiber orientation.

The tube bundle is fixed in location inside the headbox by locating devices. The vertical tube bank upstream surface has a series of vertical slots located on an equal pitch across the entire length of the tube bank. The width of the vertical slots are designed such that the width of the slot can be easily changed. Changing the slot width changes the velocity of the stock flow entering the tube bank resulting in improved fiber distribution.

The vertical tube bank is designed such that the range of fluid velocities in the initial section of the tube bank is between 3 and 50 feet per second. The exiting velocity range from the vertical tube bank is 1 to 20 feet per second.

The vertical tube bank can be fed from either a cross machine header or multiple flow injection hoses and can be used in combination with a dilution control of the flow leading to the tubebank. When used with a cross machine header, the vertical tube bank segments themselves may contain a series of holes that can deliver dilution control water into the cross machine header. The dilution control water is then transported through multiple holes located vertically between the vertical slots. The dilution water is carried into the next adjacent slot.

More specifically, the headbox apparatus according to the present invention includes the following features:

1. The vertical tube bank minimizes the mixing requirements of multiple individual tubes.
2. The mixing of flows is primarily in the cross machine direction, reducing rotational flows and maximizes cross machine mixing.
3. The vertical tube bank is constructed from one or multiple pieces.
4. The vertical tube bank is constructed with a series of slots on equal or near equal pitch across the entire width of the headbox.
5. The front side and drive side slots include a mechanism to alter the flow rate through these slots either by width or entrance configuration.
6. The vertical slot width can be easily modified to increase or decrease the pressure drop across the tube bank.
7. The vertical tube bank is located inside the headbox in the wet end side of the nozzle between the pond sides, apron support structure and nozzle roof.
8. The vertical tube bank is constructed of multiple MD and CD direction adjacent zones with varying open areas.
9. The vertical tube bank discharge side has greater than 85% open area into the nozzle area of the headbox.
10. The vertical tube bank can be utilized in headboxes where the delivery of fluid to the headbox is completed by means of a tapered header or a multiple tube/hose delivery system.
11. The vertical tube bank is operated in conjunction with a dilution control system or without a dilution control system.
12. The vertical tube bank may contain multiple holes to deliver dilution water through the block and into the tapered header.

More particularly, a conventional headbox distributor uses a tube array to spread the pulp slurry as uniformly as possible across the width of a paper machine headbox prior to the start of the drainage or other thickening process. The tube array is generally made up of individual round inlet tubes mounted is some manner to cause acceleration of the flow into each tube from a cross machine header or other form of supply of the slurry prior to the tube array. The pressure drop from the acceleration of the flow at the inlet of each tube within the array is critical to the uniformity of the flow within each tube and therefore to the uniformity of the cross machine uniformity of the headbox in general. This acceleration of the flow is also a factor in the operational cleanliness of the headbox operation. The exit end of a typical tube array may take on many shapes (round, hexagonal, rectangular or square or other shape) but eventually the flows exiting each individual tube must be re-joined prior to or within the nozzle of the headbox prior to discharge to the drainage area. The reorientation of the round tube entrance flow to the eventual rectangular shape of the nozzle will create disturbances in the flow in all directions. These disturbances must be damped or reduced in some way prior to discharge out the slice so as not to cause nonuniformities in the paper web.

The purpose of the present invention is to create the necessary pressure drop and subsequent uniform cross machine flow distribution using only vertical channels in the flow distributor. This will minimize non-cross machine flow disturbances improving cross machine uniformity of the flow. The use of only vertical channels also improves the cross machine characteristics of the fiber slurry by minimizing non cross machine forces on the fibers by the fluid flow. The design is equally applicable to headboxes using dilution to control the headbox profile or other mechanical profile controls techniques.

Further advantages of this invention are simplicity of manufacturing using easily manufactured turbulence generating devices and improved structural stiffness within the headbox to withstand internal pressures of the fluid flow.

Therefore, the primary feature of the present invention is the provision of a headbox apparatus that overcomes the problems associated with the prior art headboxes and which makes a significant contribution to the papermaking art.

Another feature of the present invention is the provision of a headbox apparatus for a papermaking machine that is easier and less costly to manufacture when compared with prior art headboxes.

A further feature of the present invention is the provision of a headbox apparatus for a papermaking machine that improves mixing of the pulp prior to discharge thereof to a downstream drainage arrangement.

Other features and advantages of the present invention will be readily apparent to those skilled in the art by a consideration of the detailed description of a preferred embodiment of the present invention contained herein.

SUMMARY OF THE INVENTION

The present invention relates to a headbox apparatus for a papermaking machine. The headbox apparatus defines a flow path for stock flowing between an upstream location and a downstream slice lip. The apparatus includes a plurality of blocks which are anchored within the flow path between the upstream location and the slice lip. Each block and an adjacent block of the plurality of blocks define therebetween a flow tube for the flow therethrough of the stock. The flow tube has an upstream portion having an upstream and a downstream end. Additionally, the flow tube has a downstream portion which has an upstream and a downstream extremity. The upstream extremity of the downstream portion extends from the downstream end of the upstream portion. The downstream portion of the flow tube has a volume which is greater than a further volume of the upstream portion of the flow tube such that when the stock flows from the upstream portion to the downstream portion of the flow tube, the stock is mixed within the downstream portion.

The upstream location in one arrangement of the present invention is a cross machine header. However, in another embodiment, the upstream location includes multiple flow injection hoses.

In a more specific embodiment of the present invention, the plurality of blocks are fabricated from high density polypropylene. However, the blocks could be fabricated from stainless steel, ceramic material or synthetic material.

Also, each block of the plurality of blocks has a first and a second end and each block has a first portion which extends from the first end of the block.

Furthermore, each block has a second portion which extends from the first portion to the second end of the block.

The first portion of the block defines a first and a second side, the first side of the first portion being planar. The second side of the first portion is also planar, the second side being disposed spaced and parallel relative to the first side.

Moreover, the second portion of the block defines a first and a second face, the first face of the second portion defining a surface and a further surface.

Additionally, the second face of the second portion defines a facing and a further facing.

More specifically, the first face is disposed spaced and parallel relative to the second face, with the first face and the second face being spaced apart by a distance which is less than a further distance between the first and second sides of the first portion.

Also, the second portion of the block defines a first rib which is disposed between the surface and the further surface, the first rib extending between the first portion and the second end of the block.

Moreover, the second portion of the block defines a second rib which is disposed between the facing and the further facing, the second rib extending between the first portion and the second end of the block.

The first portion defines a first ramp which extends between the first side of the first portion and the surface.

Also, the first portion defines a second ramp which extends between the second side of the first portion and the further facing. The arrangement is such that the flow tube is defined between the adjacent blocks so that when stock flows through the upstream portion of the flow tube into the downstream portion of the flow tube, the stock is mixed and is guided between the second rib of the block and the first rib of the adjacent block. The apparatus is structured such that when the stock flows into the downstream portion of the flow tube, a first and second vortex is generated within the downstream portion. The first vortex is disposed adjacent to the facing of the block and between the facing of the block and the surface of the adjacent block.

Furthermore, the second vortex is disposed adjacent to the further facing of the block and between the further facing of the block and the further surface of the adjacent block so that mixing of the stock within the downstream portion of the flow tube is enhanced.

Additionally, the first vortex has a rotational direction which is opposite to a further rotational direction of the second vortex for further enhancing mixing of the stock within the downstream portion of the flow tube.

More particularly, the opposite rotational directions of the first and second vortices is predictably achieved by virtue of the ramp of the adjacent block and by the second ramp of the block. The ramp of the adjacent block guides the flow of stock flowing from the upstream portion of the flow tube to generate the first vortex so that the first vortex rotates within the downstream portion of the flow tube in the rotational direction.

Also, the second ramp of the block guides the flow of stock flowing from the upstream portion of the flow tube to generate the second vortex so that the second vortex rotates within the downstream portion of the flow tube in the further rotational direction opposite to the rotational direction so that impact of the first and second vortices on a flow consistency and a velocity uniformity of the stock is reduced.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Included in such modifications would be the provision of a dilution control system for introducing dilution fluid into the flow tube or upstream thereof for controlling the cross machine basis weight profile of the resultant web.

BRIEF DESCRIPTION OF THE DRAWINGS

FIG. 6 is a sectional view taken on the line 6-6 of FIG. 1;

FIG. 8 is a view taken on the line 8-8 of FIG. 6;

FIG. 10 is an enlarged sectional view taken on the line 10-10 of FIG. 8; and FIG. 11 is an enlarged sectional view taken on the line 11-11 of FIG. 8.

Similar reference characters refer to similar parts throughout the various FIGS. of the drawings.

DETAILED DESCRIPTION OF THE DRAWINGS

Figure 1:
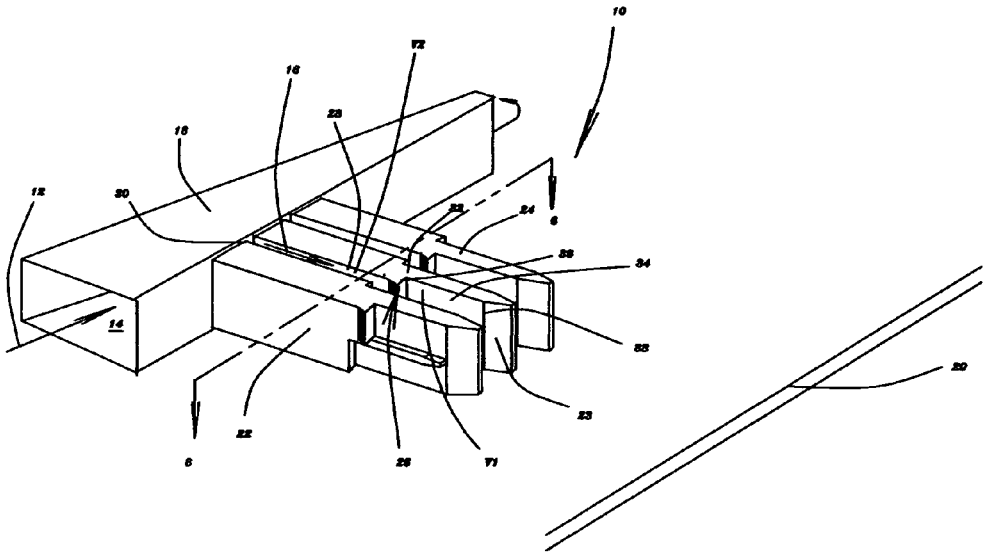
FIG. 1 is a perspective view of a preferred headbox apparatus according to the present invention for a papermaking machine.

FIG. 1 is a perspective view of a headbox apparatus generally designated 10 according to the preferred embodiment of present invention for a papermaking machine. As shown in FIG. 1, the headbox apparatus 10 defines a flow path 12 for stock 14 flowing as indicated by the arrow 16 between an upstream location such as a header 18 and a downstream slice lip 20. The apparatus 10 includes a plurality of blocks 22, 23 and 24 which are anchored within the flow path 12 and 16 between the header 18 and the slice lip 20. Each block such as block 22 and an adjacent block 23 of the plurality of blocks 22-24 define therebetween a flow tube generally designated 26 for the flow therethrough of the stock 14. The flow tube 26 has an upstream portion 28 having an upstream and a downstream end 30 and 32 respectively. Additionally, the flow tube 26 has a downstream portion 34 having an upstream and a downstream extremity 36 and 38 respectively. The upstream extremity 36 of the downstream portion 34 extends from the downstream end 32 of the upstream portion 28. The downstream portion 34 of the flow tube 26 has a volume V1 which is greater than a further volume V2 of the upstream portion 28 of the flow tube 26 such that when the stock 14 flows as indicated by the arrow 16 from the upstream portion 28 to the downstream portion 34 of the flow tube 26, the stock 14 is mixed within the downstream portion 34.

In a more specific embodiment of the present invention, the plurality of blocks 22-24 are fabricated from high density polypropylene.

Also, it will be understood by those skilled in the art that instead of a cross machine direction tapered header 18, multiple flow injection hoses could be used at the upstream location. Also, the headbox could be provided with a stock dilution control for controlling the cross machine direction profile of the resultant web.

Figure 2:
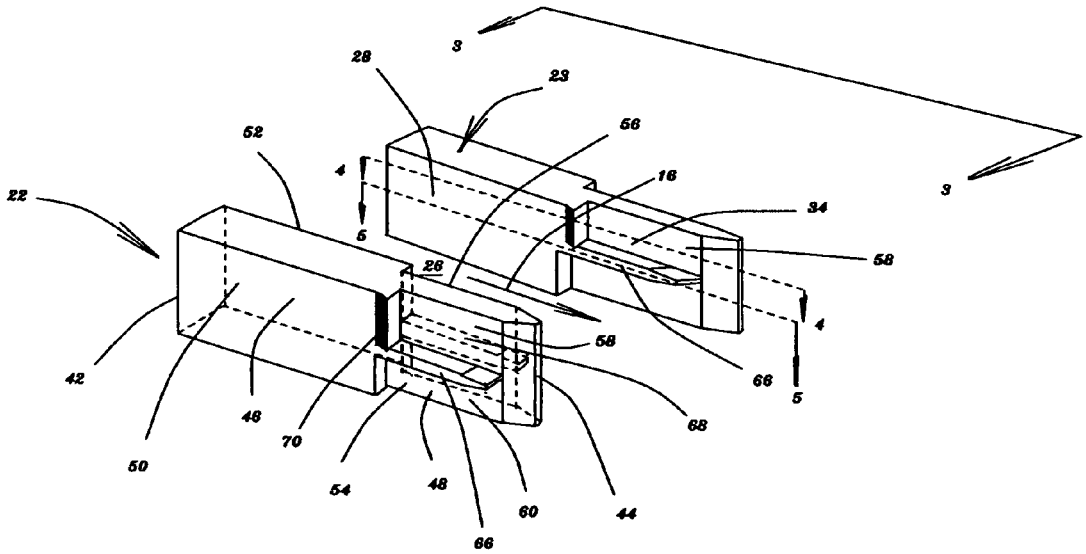
FIG. 2 is an exploded view of the blocks shown in FIG. 1.

FIG. 2 is an exploded view of the blocks generally designated 22 and 23 shown in FIG. 1. As shown in FIG. 2, each block such as block 22 of the plurality of blocks 22-24 has a first and a second end 42 and 44 respectively, the block 22 having a first portion 46 which extends from the first end 42 of the block 22.

Furthermore, the block 22 has a second portion 48 which extends from the first portion 46 to the second end 44 of the block 22.

The first portion 46 of the block 22 defines a first and a second side 50 and 52 respectively, the first side 50 of the first portion 46 being planar. The second side 52 of the first portion 46 is also planar, the second side 52 being disposed spaced and parallel relative to the first side 50.

Moreover, the second portion 48 of the block 22 defines a first and a second face 54 and 56 respectively, the first face 54 of the second portion 48 defining a surface 58 and a further surface 60.

Figure 3:
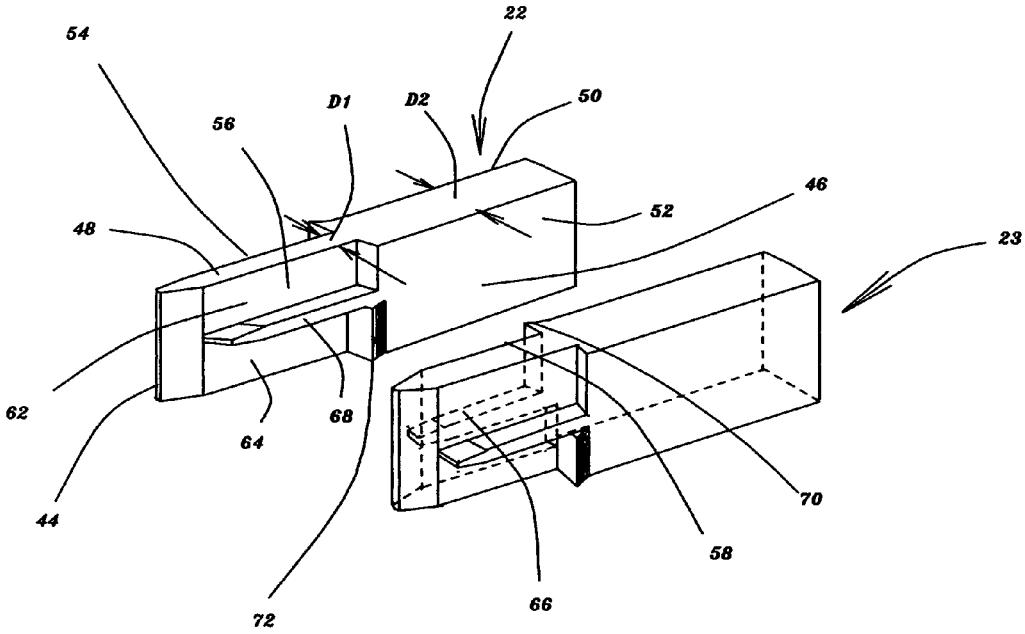
FIG. 3 is a view taken on the line 3-3 of FIG. 2.

FIG. 3 is a view taken on the line 3-3 of FIG. 2. As shown in FIG. 3, the second face 56 of the second portion 48 defines a facing 62 and a further facing 64.

More specifically, the first face 54 is disposed spaced and parallel relative to the second face 56, with the first face 54 and the second face 56 being spaced apart by a distance D1 which is less than a further distance D2 between the first and second sides 50 and 52 respectively of the first portion 46.

As shown in FIG. 2, the second portion 48 of the block 22 defines a first rib 66 which is disposed between the surface 58 and the further surface 60, the first rib 66 extending between the first portion 46 and the second end 44 of the block 22.

Moreover, as shown in FIG. 3, the second portion 48 of the block 22 defines a second rib 68 which is disposed between the facing 62 and the further facing 64, the second rib 68 extending between the first portion 46 and the second end 44 of the block 22.

As shown in FIG. 2, the first portion 46 defines a first ramp 70 which extends between the first side 50 of the first portion 46 and the surface 58.

As shown in FIG. 3, the first portion 46 defines a second ramp 72 which extends between the second side 52 of the first portion 46 and the further facing 64. The arrangement is such that the flow tube 26 as shown in FIG. 1 is defined between the adjacent blocks 22 and 23 so that when stock 14 flows as indicated by the arrow 16 as shown in FIG. 2 through the upstream portion 28 of the flow tube 26 into the downstream portion 34 of the flow tube 26, the stock 14 is mixed within the downstream portion 34 the stock 14 being guided between the second rib 68 of the block 22 and the first rib 66 of the adjacent block 23.

Figure 4:
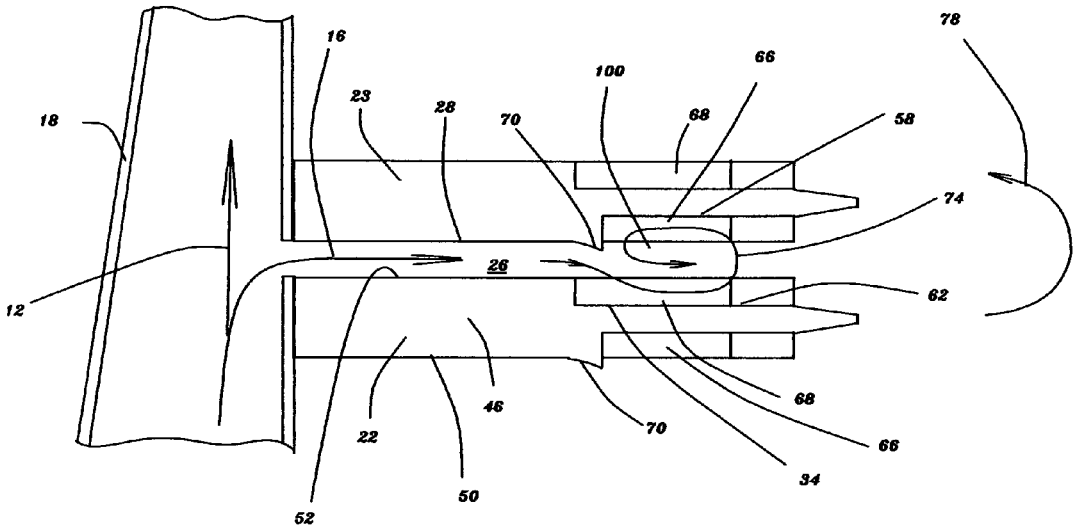
FIG. 4 is a view taken on the line 4-4 of FIG. 3.

FIG. 4 is a view taken on the line 4-4 of FIG. 2. As shown in FIG. 4, the apparatus 10 is structured such that the stock 14 flowing into the downstream portion 34 of the flow tube 26 separates into a first vortex 74. The first vortex 74 is disposed adjacent to the facing 62 of the block 22 and between the facing 62 of the block 22 and the surface 58 of the adjacent block 23.

Figure 5:
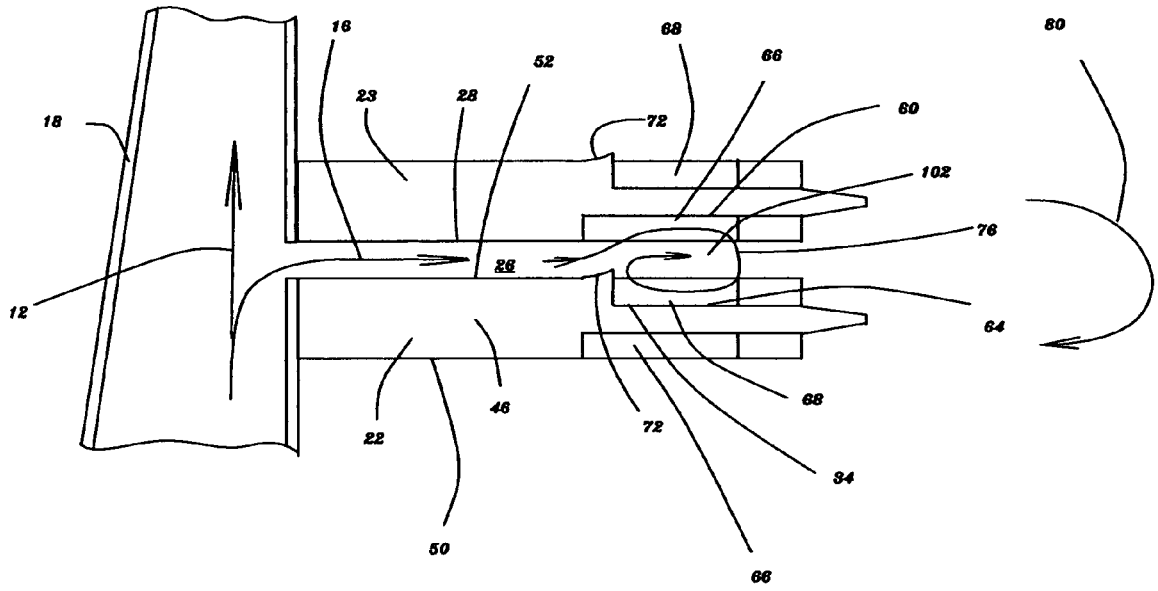
FIG. 5 is a view taken on the line 5-5 of FIG. 3.

FIG. 5 is a view taken on the line 5-5 of FIG. 2. As shown in FIG. 5, the apparatus 10 is structured such that the stock 14 flowing into the downstream portion 34 of the flow tube 26 separates into a second vortex 76. The second vortex 76 is disposed adjacent to the further facing 64 of the block 22 and between the further facing 64 of the block 22 and the further surface 60 of the adjacent block 23 so that mixing of the stock 14 within the downstream portion 34 of the flow tube 26 is enhanced.

Additionally, as shown in FIG. 4, the first vortex 74 has a counter clockwise rotational direction as indicated by the arrow 78 which is opposite to a clockwise further rotational direction as shown in FIG. 5 such clockwise further rotational direction being indicated by the arrow 80. Accordingly, the counter rotating vortices 74 and 76 as shown in FIGS. 4 and 5 respectively further enhance mixing of the stock 14 within the downstream portion 34 of the flow tube 26.

More particularly, as shown in FIGS. 3-5, the opposite rotational directions as indicated by arrows 78 and 80 respectively of the first and second vortices 74 and 76 is predictably achieved by virtue of the first ramp 70 of the adjacent block 23 and by the second ramp 72 of the block 22. The first ramp 70 of the adjacent block 23 as shown in FIG. 4 guides the flow of stock flowing from the upstream portion 28 of the flow tube 26 to generate the first vortex 74 so that the first vortex 74 rotates within the downstream portion 34 of the flow tube 26 in the rotational direction as indicated by the arrow 78.

Also, as shown in FIG. 5, the second ramp 72 of the block 22 guides the flow of stock flowing from the upstream portion 28 of the flow tube 26 to generate the second vortex 76 so that the second vortex 76 rotates within the downstream portion 34 of the flow tube 26 in the further rotational direction 80 opposite to the rotational direction 78 so that impact of the first and second vortices 74 and 76 respectively on a flow consistency and a velocity uniformity of the stock 14 is reduced.

FIG. 6 is a sectional view taken on the line 6-6 of FIG. 1. As shown in FIG. 6, each of the blocks 22-24 has a first and a second rib 66 and 68 respectively. Also, each of the blocks 22-24 has a first and a second ramp 70 and 72 respectively.

Figure 7:
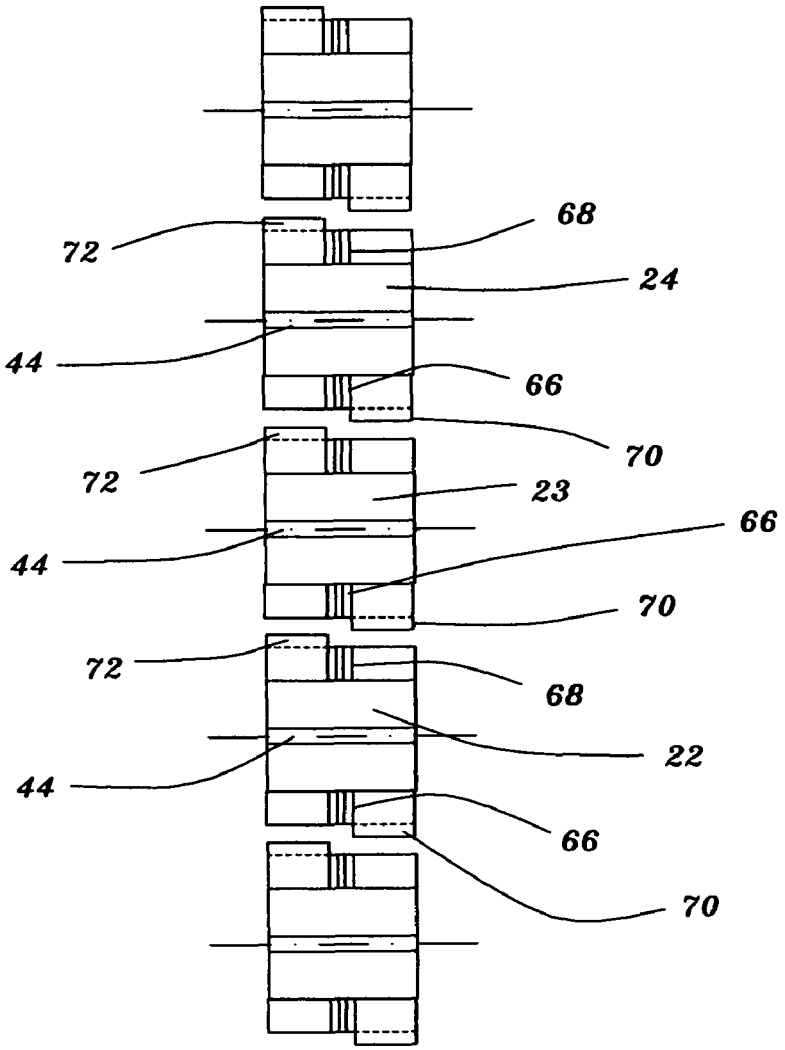
FIG. 7 is a view taken on the line 7-7 of FIG. 6.

FIG. 7 is a view taken on the line 7-7 of FIG. 6. As shown in FIG. 7, each of the blocks 22-24 has a second end 44. Also, each of the blocks 22-24 has a first and a second ramp 70 and 72 respectively. Additionally, each of the blocks 22-24 has a first and a second rib 66 and 68 respectively.

FIG. 8 is a view taken on the line 8-8 of FIG. 6. As shown in FIG. 8, the block 22 has a first rib 66. Also, the block 22 has a first ramp 70.

Figure 9:
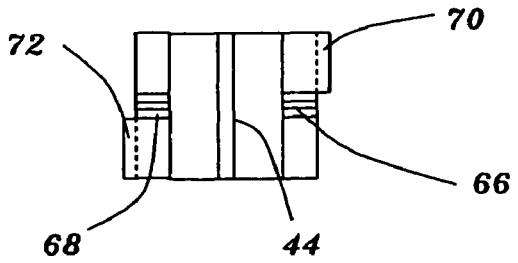
FIG. 9 is a view taken on the line 9-9 of FIG. 8.

FIG. 9 is a view taken on the line 9-9 of FIG. 8. As shown in FIG. 9, the block 22 has a second end 44. Also, the block 22 has a first and a second ramp 70 and 72 respectively. Additionally, the block 22 has a first and a second rib 66 and 68 respectively.

FIG. 10 is an enlarged sectional view taken on the line 10-10 of FIG. 8. As shown in FIG. 10, the block 22 defines the second ramp 72 which guides the stock flow to generate a vortex 76 in a clockwise rotational direction 80 as shown in FIG. 5.

FIG. 11 is an enlarged sectional view taken on the line 11-11 of FIG. 8. As shown in FIG. 11, the block 23 defines the first ramp 70 which guides the stock flow to generate a vortex 74 in a counter clockwise rotational direction 78 as shown in FIG. 4.

In operation of the headbox apparatus 10 of the present invention, the stock 14 flows into the flow tube 26 as indicated by the arrow 16. The velocity of the flow of the stock 14 increases during passage thereof through the upstream portion 28 of the flow tube 26. Such increased velocity assists in maintaining the cleanliness of the flow tube. As the stock 14 exits from the upstream portion 28 of the flow tube 26 into the larger volume V1 of the downstream portion 34 of the flow tube 26, the velocity of the stock 14 is reduced and vortices 74 and 76 are generated within the downstream portion 34 of the flow tube 26. The downstream portion 34 with volume V1 is a single chamber but is to a degree divided into an upper chamber 100 and a lower chamber 102 by the rib 68 of the block 22 and the rib 66 of the adjacent block 23 as shown in FIGS. 4, 5, 8, 10 and 11.

The vortex 74 generated within the upper chamber 100 as shown in FIGS. 4 and 11 is caused to flow in a generally counter clockwise direction 78 because as the stock 14 flows from the upstream portion 28 into the upper chamber of the downstream portion 34, the first ramp 70 of the adjacent block 23 guides such stock flow in the counter clockwise direction 78.

Conversely, the vortex 76 generated within the lower chamber 102 as shown in FIGS. 5 and 10 is caused to flow in a generally clockwise direction 80 because as the stock 14 flows from the upstream portion 28 into the lower chamber of the downstream portion 34, the second ramp 72 of the block 22 guides such stock flow in the clockwise direction 80. Thus, the opposite rotational directions of the vortices 74 and 76 enhance mixing of the stock 14 within the upper and lower chambers which are interconnected with each other. Therefore, the stock 14 within the downstream portion 34 of the flow tube 26 is thoroughly mixed before discharge thereof through the slice lip 20.

It will be understood by those skilled in the art that the blocks 22-24 could be fabricated from stainless steel, ceramic material or any suitable synthetic material.

Also, the present invention could include a dilution control mechanism for introducing diluting fluid into one or more flow tubes or upstream relative to the flow tubes for controlling the cross machine basis weight profile of the resultant sheet.

The headbox according to the present invention provides a unique arrangement for enhancing mixing of stock flowing through the flow tubes of a tube bank of a headbox.

What is claimed is:

1. A headbox apparatus for a papermaking machine, said headbox apparatus defining a flow path for stock flowing between an upstream location and a downstream slice lip, said apparatus comprising:

a plurality of blocks which are anchored within the flow path between the upstream location and the slice lip;

each block and an adjacent block of said plurality of blocks defining therebetween a flow tube for the flow therethrough of the stock;

said flow tube having an upstream portion having an upstream and a downstream end;

said flow tube having a downstream portion having an upstream and a downstream extremity, said upstream extremity of said downstream portion extending from said downstream end of said upstream portion;

said downstream portion of said flow tube having a volume which is greater than a further volume of said upstream portion of said flow tube such that when the stock flows from said upstream portion to said downstream portion of said flow tube, the stock is mixed within said downstream portion;

each block of said plurality of blocks having a first and a second end;

each block having a first portion which extends from said first end of said block;

each block having a second portion which extends from said first portion to said second end of said block;

said first portion of said block defining a first and a second side;

said second portion of said block defining a first and a second face;

said first face of said second portion defining a surface and a further surface;

said second face of said second portion defining a facing and a further facing;

said first face and said second face being spaced apart by a distance which is less than a further distance between said first and second sides of said first portion;

said second portion of said block defines a first rib which is disposed between said surface and said further surface, said first rib extending between said first portion and said second end of said block;

said second portion of said block defining a second rib which is disposed between said facing and said further facing, said second rib extending between said first portion and said second end of said block;

said first portion defines a first ramp which extends between said first side of said first portion and said surface; and said first portion defining a second ramp which extends between said second side of said first portion and said further facing, the arrangement being such that said flow tube is defined between said adjacent blocks so that when stock flows through said upstream portion of said flow tube into said downstream portion of said flow tube, the stock is guided by said second rib of said block and said first rib of said adjacent block such that the stock is mixed within said downstream portion, such flow of stock generating a first and second vortex, said first vortex being disposed adjacent to said facing of said block and between said facing of said block and said surface of said adjacent block, said second vortex being disposed adjacent to said further facing of said block and between said further facing of said block and said further surface of said adjacent block so that mixing of the stock within said downstream portion of said flow tube is enhanced.

2. A headbox apparatus as set forth in claim 1 wherein said plurality of blocks are fabricated from high density polypropylene.

3. A headbox apparatus as set forth in claim 1 wherein said plurality of blocks are fabricated from stainless steel.

4. A headbox apparatus as set forth in claim 1 wherein said plurality of blocks are fabricated from ceramic material.

5. A headbox apparatus as set forth in claim 1 wherein said plurality of blocks are fabricated from synthetic material.

6. A headbox apparatus as set forth in claim 1 wherein said first side of said first portion is planar, said second side of said first portion is planar, said second side being disposed spaced and parallel relative to said first side.

7. A headbox apparatus as set forth in claim 6 wherein said first face is disposed spaced and parallel relative to said second face.

8. A headbox apparatus as set forth in claim 1 wherein said first vortex has a rotational direction which is opposite to a further rotational direction of said second vortex for further enhancing mixing of the stock within said downstream portion of said flow tube.

9. A headbox apparatus as set forth in claim 8 wherein said opposite rotational directions of said first and second vortices is predictably achieved by virtue of said first ramp of said adjacent block and by said second ramp of said block, said first ramp of said adjacent block guiding said flow of stock flowing from said upstream portion of said flow tube to generate said first vortex so that said first vortex rotates within said downstream portion of said flow tube in said rotational direction;

said second ramp of said block guiding said flow of stock flowing from said upstream portion of said flow tube to generate said second vortex so that said second vortex rotates within said downstream portion of said flow tube in said further rotational direction opposite to said rotational direction so that impact of said first and second vortices on a flow consistency and a velocity uniformity of the stock is reduced.

10. A headbox apparatus for a papermaking machine, said headbox apparatus defining a flow path for stock flowing between an upstream header and a downstream slice lip, said apparatus comprising:

a plurality of blocks which are anchored within the flow path between the header and the slice lip;

each block and an adjacent block of said plurality of blocks defining therebetween a flow tube for the flow therethrough of the stock;

said flow tube having an upstream portion having an upstream and a downstream end;

said flow tube having a downstream portion having an upstream and a downstream extremity, said upstream extremity of said downstream portion extending from said downstream end of said upstream portion;

said downstream portion of said flow tube having a volume which is greater than a further volume of said upstream portion of said flow tube such that when the stock flows from said upstream portion to said downstream portion of said flow tube, the stock is mixed within said downstream portion;

each block of said plurality of blocks having a first and a second end;

each block having a first portion which extends from said first end of said block and a second portion which extends from said first portion to said second end of said block;

said first portion of said block defining a first and a second side, said first and second sides of said first portion being planar, said second side being disposed spaced and parallel relative to said first side;

said second portion of said block defining a first and a second face;

said first face of said second portion defining a surface and a further surface;

said second face of said second portion defining a facing and a further facing;

said first face being disposed spaced and parallel relative to said second face, said first face and said second face being spaced apart by a distance which is less than a further distance between said first and second sides of said first portion;

said second portion of said block defines a first rib which is disposed between said surface and said further surface, said first rib extending between said first portion and said second end of said block;

said second portion of said block defining a second rib which is disposed between said facing and said further facing, said second rib extending between said first portion and said second end of said block;

said first portion defines a first ramp which extends between said first side of said first portion and said surface; and said first portion defusing a second ramp which extends between said second side of said first portion and said further facing, the arrangement being such that said flow tube is defined between said adjacent blocks so that when stock flows through said upstream portion of said flow tube into said downstream portion of said flow tube, the stock is guided by said second rib of said block and said first rib of said adjacent block such that the stock is mixed within said downstream portion, such flow of stock generating a first and second vortex, said first vortex being disposed adjacent to said facing of said block and between said facing of said block and said surface of said adjacent block, said second vortex being disposed adjacent to said further facing of said block and between said further facing of said block and said further surface of said adjacent block so that mixing of the stock within said downstream portion of said flow tube is enhanced.

11. A headbox apparatus for a papermaking machine, said headbox apparatus defining a flow path for stock flowing between an upstream header and a downstream slice lip, said apparatus comprising:

a plurality of blocks which are anchored within the flow path between the header and the slice lip;

each block and an adjacent block of said plurality of blocks defining therebetween a flow tube for the flow therethrough of the stock;

said flow tube having an upstream portion having an upstream and a downstream end;

said flow tube having a downstream portion having an upstream and a downstream extremity, said upstream extremity of said downstream portion extending from said downstream end of said upstream portion;

said downstream portion of said flow tube having a volume which is greater than a further volume of said upstream portion of said flow tube such that when the stock flows from said upstream portion to said downstream portion of said flow tube, the stock is mixed within said downstream portion;

said plurality of blocks are fabricated from high density polypropylene;

each block of said plurality of blocks has a first and a second end;

each block has a first portion which extends from said first end of said block;

each block having a second portion which extends from said first portion to said second end of said block;

said first portion of said block defining a first and a second side, said first and second sides of said first portion being planar, said second side being disposed spaced and parallel relative to said first side;

said second portion of said block defining a first and a second face;

said first face of said second portion defining a surface and a further surface;

said second face of said second portion defining a facing and a further facing;

said first face being disposed spaced and parallel relative to said second face, said first face and said second face being spaced apart by a distance which is less than a further distance between said first and second sides of said first portion;

said second portion of said block defining a first rib which is disposed between said surface and said further surface, said first rib extending between said first portion and said second end of said block;

said second portion of said block defining a second rib which is disposed between said facing and said further facing, said second rib extending between said first portion and said second end of said block;

said first portion defining a first ramp which extends between said first side of said first portion and said further surface;

said first portion defining a second ramp which extends between said second side of said first portion and said further facing, the arrangement being such that said flow tube is defined between said adjacent blocks so that when stock flows through said upstream portion of said flow tube into said downstream portion of said flow tube, the stock is mixed within said downstream portion, the stock being guided by said second rib of said block and said first rib of said adjacent block such that a first and second vortex are generated within said downstream portion of said flow tube, said first vortex being disposed adjacent to said facing of said block and between said facing of said block and said surface of said adjacent block, said second vortex being disposed adjacent to said further facing of said block and between said further facing of said block and said further surface of said adjacent block so that mixing of said stock within said downstream portion of said flow tube is enhanced;

said first vortex having a rotational direction which is opposite to a further rotational direction of said second vortex for further enhancing mixing of the stock within said downstream portion of said flow tube;

said opposite rotational directions of said first and second vortices being predictably achieved by virtue of said first ramp of said adjacent block and by said second ramp of said block, said first ramp of said adjacent block guiding the flow of stock flowing from said upstream portion of said flow tube to generate said first vortex so that said first vortex rotates within said downstream portion of said flow tube in said rotational direction; and said second ramp of said block guiding the flow of stock flowing from said upstream portion of said flow tube to generate said second vortex so that said second vortex rotates within said downstream portion of said flow tube in said further rotational direction opposite to said rotational direction so that impact of said first and second vortices on a flow consistency and a velocity uniformity of said stock is reduced.

* * * * *

UNITED STATES PATENT AND TRADEMARK OFFICE

CERTIFICATE OF CORRECTION

PATENT NO. : 7,897,016 B2
APPLICATION NO. : 12/012514
DATED : March 1, 2011
INVENTOR(S) : James Leroy Ewald It is certified that error appears in the above-identified patent and that said Letters Patent is hereby corrected as shown below:

In column 10, line 57 Claim 10 “defusing” should read --defining--

Signed and Sealed this
Nineteenth Day of July, 2011

David J. Kappos

David J. Kappos
*Director of the United States Patent and Trademark Office*